US005647481A

United States Patent [19]

Hundertmark et al.

[11] Patent Number: 5,647,481

[45] Date of Patent: Jul. 15, 1997

[54] DUAL CONTAINER SYSTEM FOR TWO COMPONENT HAIR DYE

[75] Inventors: Volker Hundertmark, Raddestorf; Peter Funke; Dietholf Mehl, both of Duesseldorf, all of Germany

[73] Assignee: Henkel Kommanditgesellschaft auf Aktien, Duesseldorf, Germany

[21] Appl. No.: 559,343

[22] Filed: Nov. 15, 1995

[30] Foreign Application Priority Data

May 17, 1995 [WO] WIPO ..... DM/033-033

[51] Int. Cl.[6] ..... B65D 25/08

[52] U.S. Cl. ..... 206/219; 206/568; 215/10; 215/DIG. 8

[58] Field of Search ..... 206/219, 221, 206/568, 222; 215/6, 10, DIG. 8

[56] References Cited

U.S. PATENT DOCUMENTS

| | | | |
|---|---|---|---|
| 3,720,523 | 3/1973 | Nakagami | 206/219 |
| 4,230,517 | 10/1980 | Hildebrandt et al. | 206/221 |
| 4,483,439 | 11/1984 | Steigerwald et al. | 206/568 |
| 4,823,946 | 4/1989 | Stoeffler et al. | 206/221 |
| 4,927,013 | 5/1990 | Van Brunt et al. | 206/221 |
| 4,936,446 | 6/1990 | Lataix | 206/221 |
| 5,277,303 | 1/1994 | Goyet et al. | 206/221 |

FOREIGN PATENT DOCUMENTS

| | | | |
|---|---|---|---|
| 0528707 | 5/1995 | European Pat. Off. . | |
| 1436648 | 5/1976 | United Kingdom | 215/DIG. 8 |

*Primary Examiner*—Paul T. Sewell
*Assistant Examiner*—Luan K. Bui
*Attorney, Agent, or Firm*—Ernest G. Szoke; Wayne C. Jaeschke; Kenneth Watov

[57] ABSTRACT

A dispensing package system for a liquid product including first and second components which must be mixed together prior to use, includes a first container for containing the first component, and a second container for containing the second component prior to use. The first container includes a top dispensing nozzle sealed off by a cap when not in use, and a bottom port sealed by a removable plug from the interior thereof. To mix the components together a user unscrews a cap from the second container, and screws the neck of the second container into a threaded boss of a skirt secured to the bottom of the first container, for forcing a top portion of the neck of the second container into the bottom port of the first container for frictional engagement therewith, and for forcing the plug out of the port into the interior of the first container. The second container is held in position by the skirt, and the joined first and second containers can now be shaken for mixing the first and second components together, and thereafter dispensing the resultant liquid product from the dispensing nozzle of the first container.

3 Claims, 6 Drawing Sheets

DUAL CONTAINER SYSTEM FOR TWO COMPONENT HAIR DYE

RELATED APPLICATIONS

The present invention is related to co-pending design applications Serial No. 29,046,499, Ser. No. 29/049,574, Ser. No. 29/046,862, and Ser. No. 29/046,861, each one of which was filed herewith. The teachings of the related applications are incorporated herein by reference to the extent they do conflict herewith.

BACKGROUND 1.0 Field of the Invention

The field of the present invention relates generally to containers for fluid products, and more specifically to container systems for facilitating the sale, storage, and use of liquid products or fluid preparations that consist of two components that must be mixed together before use, but stored separately prior to use.

2.0 Discussion of Related Art

Many liquid or fluid products and preparations require the mixing of two or more individual components just prior to use for obtaining optimum results. For example, certain hair dye preparations consist of at least two liquid components which must be sold and stored separately, and which are mixed together just prior to use to provide a user with the best results. In the case of a certain known hair dye products, for example, a user purchases the individual components in separate bottles, and then must mix these components together in a common bottle by spilling the contents of one bottle into the other bottle, for mixing the two components together just prior to use. During this step of pouring the contents of one component from one bottle into a receiving bottle, it is possible that the user may accidentally have some of the product being poured miss the receiving bottle and dribble around the outside of the receiving bottle or onto the countertop or floor on which the receiving bottle is resting. In the case of hair dyes, and other products such as epoxy compounds, for example, such accidents can damage surrounding tabletops or floors, and in the least will cause unwelcome clean up tasks. The present inventors recognized that there is a need in the art for developing a container system to minimize spillage of liquid components, while facilitating the mixing together of the components required for providing the ultimate liquid or fluid product for use. It should be noted that one of the components is typically a liquid, whereas the other component can be either a liquid or granular, for example.

3.0 Summary of the Invention

An object of the invention is to provide an improved container system for facilitating the storage and later mixing together of individual components of a multicomponent liquid product.

Another object of the invention is to provide an improved method and apparatus for substantially avoiding spillage of liquid components of a multicomponent liquid product, during mixing together of individual components prior to use.

With the problems of the prior art in mind, these and other objects are obtained in one embodiment of the invention by storing one of the individual components of a multicomponent liquid product in a relatively large first container of sufficient size to receive other of the individual components of the liquid products for mixing therein prior to use. A dispensing nozzle is provided at the top opening of the first bottle or container, and a sealing cap is adapted for sealing off the outlet of the dispensing nozzle during storage of the liquid contents therein. A central portion of the bottom of the first container or bottle includes inlet port means for receiving the outlet or neck of a second bottle or container containing a second component of the liquid product, for permitting the contents of the second container to be directly poured into the first container to facilitate the mixing of the two components prior to use. In one embodiment of the invention the inlet port means of the first bottle or container is initially sealed off by a removable plug. During storage, shipment, and sale, and up to the time of use by user, the first and second containers are kept apart, and a sealing cap is screwed onto the outlet or neck of the second container. An apron or skirt section includes means for snapping onto a retaining means on the bottom of the first container, and further includes a female threaded centrally located internal hub for permitting a threaded neck of the second container to be screwed thereinto in a manner permitting the upper portion of the neck of the second container to enter into the inlet port means on the bottom of the first container, and push out the plug blocking the inlet port means, thereby permitting the second component in the second container to be mixed with the first component in the first container. After mixing, the cap on the dispensing nozzle on the first container is removed, and the mixed liquid products can then be dispensed from the first container by inverting the container to permit the mixture to be dispensed. In a preferred embodiment, the outlet or neck of the second container and the inlet port of the first container are designed to provide a tight frictional fit therebetween for substantially preventing the leakage of fluid or liquid from the mated connection therebetween.

BRIEF DESCRIPTION OF THE DRAWINGS

Various embodiments of the present invention are shown and described herein with reference to the drawings, in which like items are identified by the same reference designation, wherein.

DETAILED DESCRIPTION OF THE INVENTION

Figure 1:
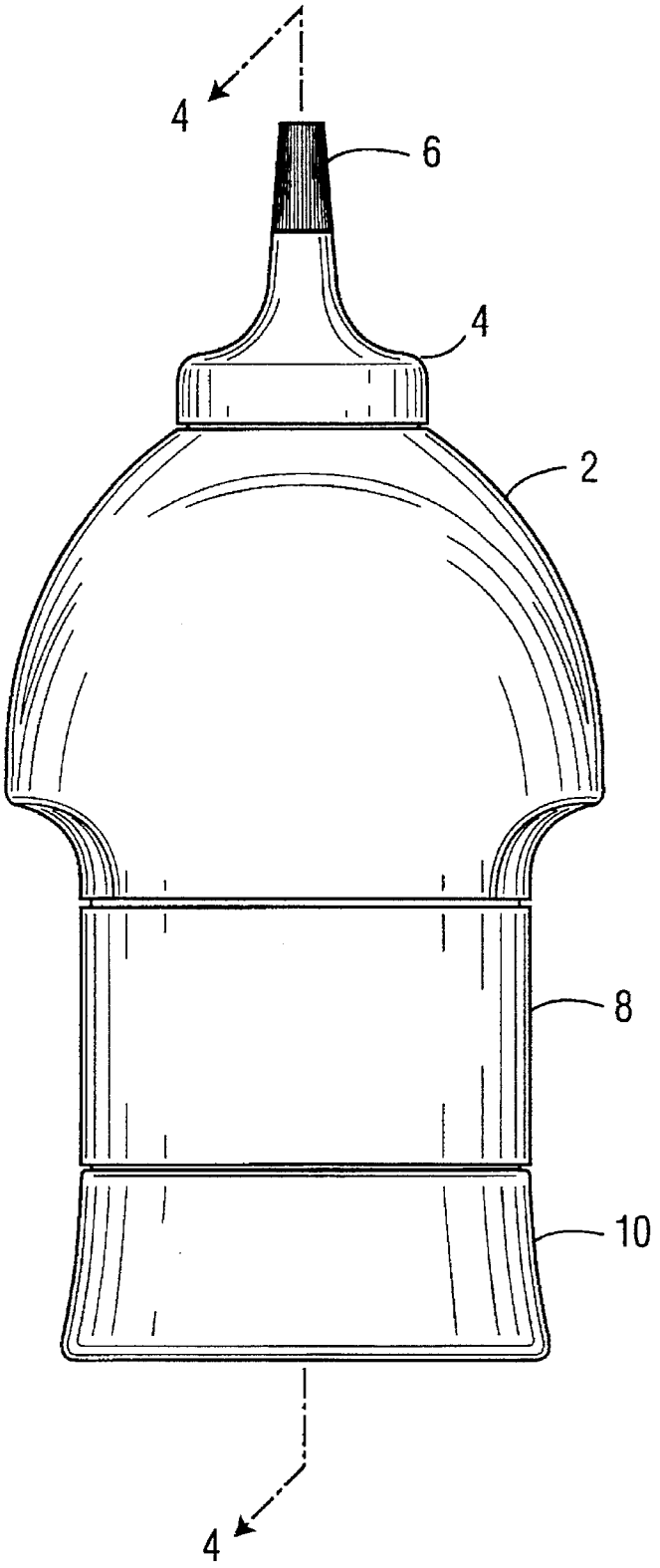
FIG. 1 shows a front elevational view of a first or upper container mated with a second or lower container of the container system for one embodiment of the invention.

The present invention provides a multicontainer system for accommodating a liquid product that includes individual multiple components that must be mixed together before use of the liquid product. In one embodiment of the invention, as shown in FIG. 1, the container system includes a first container 2 having an upper outlet to which a dispensing nozzle 4 is secured. A cap 6 is screwed onto an outlet of a dispensing nozzle 4 to seal off the outlet. A centrally located skirt 8 is adapted as will be further described below for snapping onto the bottom portion of the first container 2. A second container 10, as will be shown below, is mated with a centrally located inlet port of the first container 2 partly through use of the skirt 8 as will be described in detail below.

Figure 2:
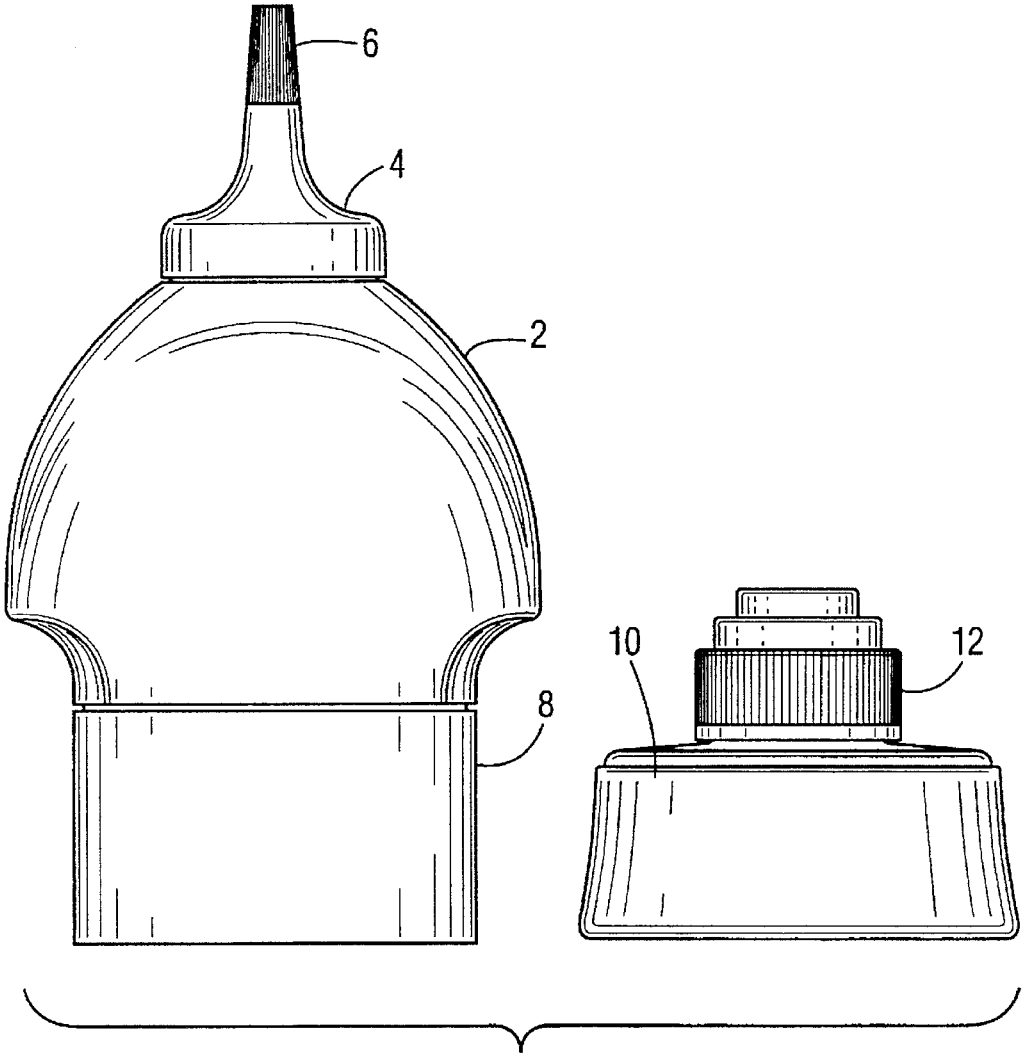
FIG. 2 is a front elevational view showing each of the first and second container individually for one embodiment of the invention.

In FIG. 2, front elevational views of the first container 2 with skirt 8 attached thereto, is shown adjacent to a front elevational view of the second container 10 with a shipping or storage cap 12 screwed onto the neck of the container 10, for one embodiment of the invention. Note that the cap 6 for container 2, and the cap 12 for container 10 each have a knurled portion for facilitating either removal or installation of the caps 6 and 12 from their container 2, 10, respectively.

Figure 3:
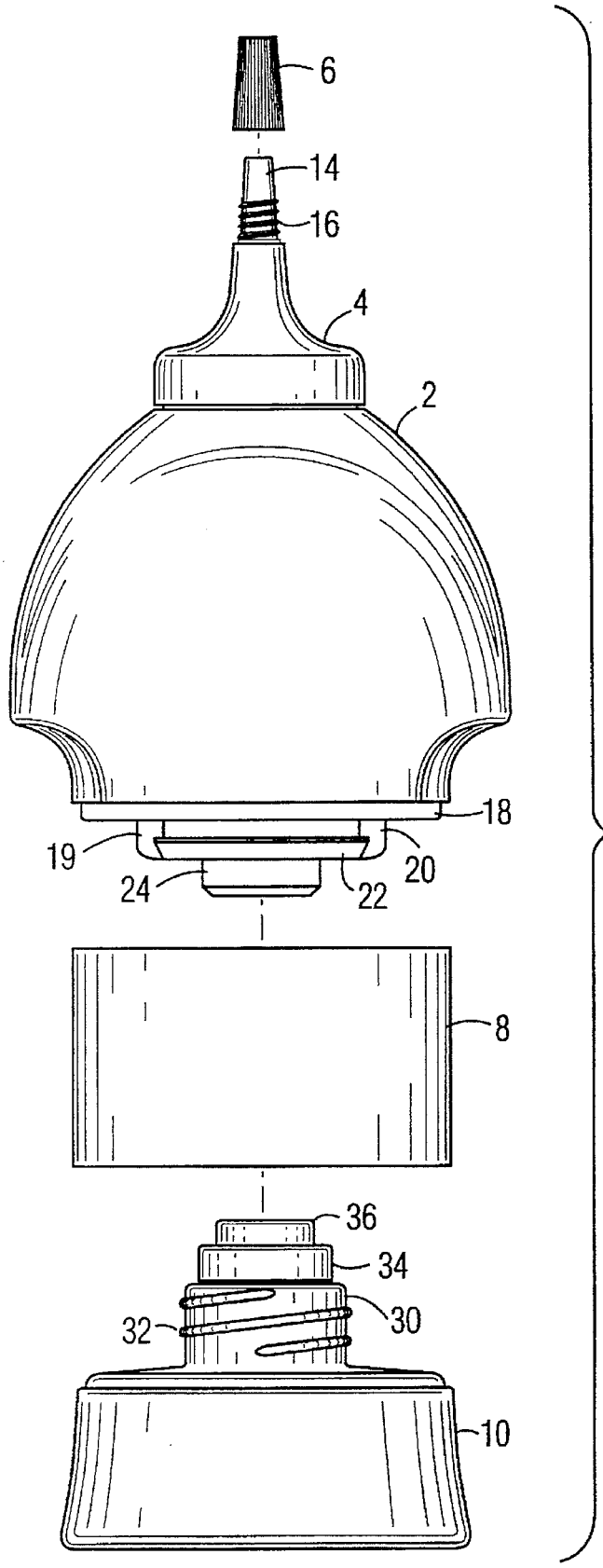
FIG. 3 shows an exploded assembly diagram for one embodiment of the invention.
Figure 6:
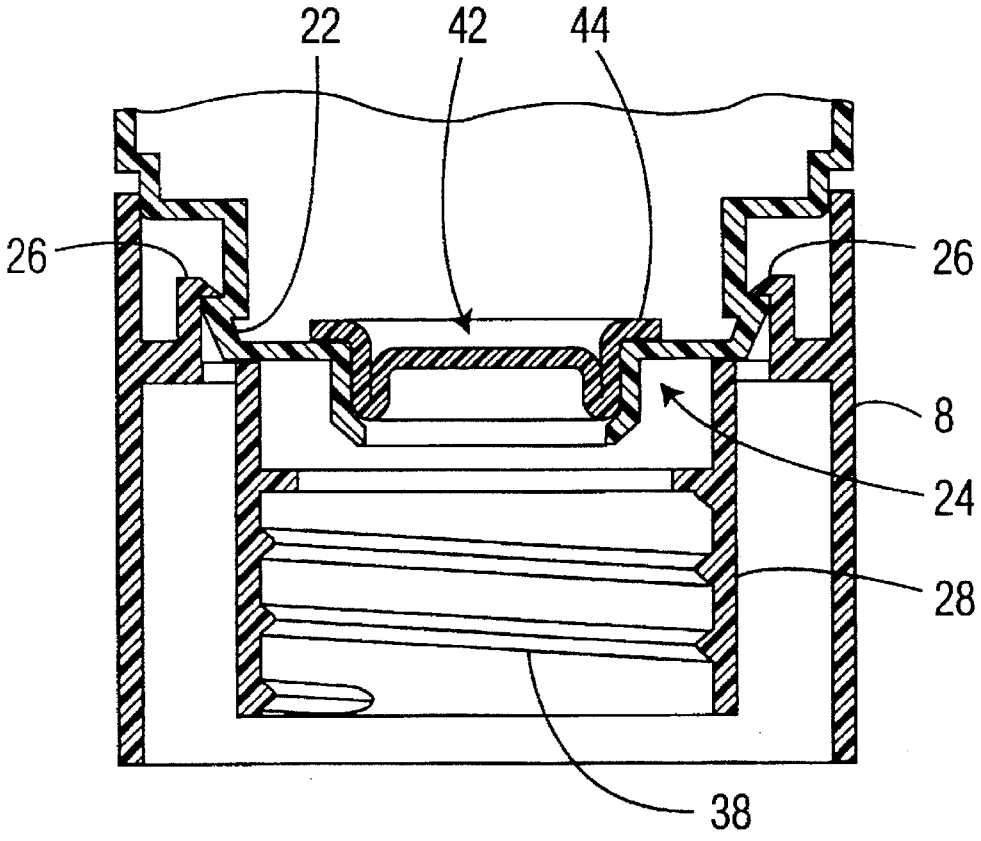
FIG. 6 shows a cross sectional view taken along 6—6 of FIG. 4 of a snap-in locking mechanism for securing a center apron or skirt to the first container.

With reference to FIG. 3, an exploded assembly diagram is shown of the multicomponent liquid product container system. In this embodiment of the invention, with the cap 6 removed from the dispensing nozzle 4, the upper neck 14 of nozzle 4 includes a plurality of threads 16 for securing cap 6 thereto. The bottom portion of container 2 is configured with a reduced narrow circumferential boss 18 that is dimensioned for frictionally engaging the upper inside walls of the apron or skirt 8. A pair of opposing boss arms 19, 20 protrude downward from the circumferential reduced rim portion 18 (see FIG. 7). A semicircular retaining ring 22 is located between arms 19 and 20 on either side of these arms (see FIG. 7), with only one side being shown in FIG. 3. The retaining ring 22 has side portions which are downwardly convergent, as shown. An inlet port 24 is concentric with and protrudes downwardly from the retaining ring 22. The skirt 8, more particularly as shown in FIG. 6, includes projecting upward from an upper inside portion opposing narrow arcuate retaining fingers 26 that permit the skirt 8 to be snapped onto the retaining ring 22, as shown, for securing the apron or skirt 8 to the first container 2. Note that the upper portion of the internal threaded boss 28 has uppermost circumferential top portions that butt against the bottom of the retaining ring or flange 22, whereby the retaining flange 22 is wedged at its outer portions between mounting or retaining fingers 26 and the bottom of retaining flange 22, as shown. As a result, the skirt 8 is substantially captively held onto the container 2 as shown in FIG. 2.

Figure 7:
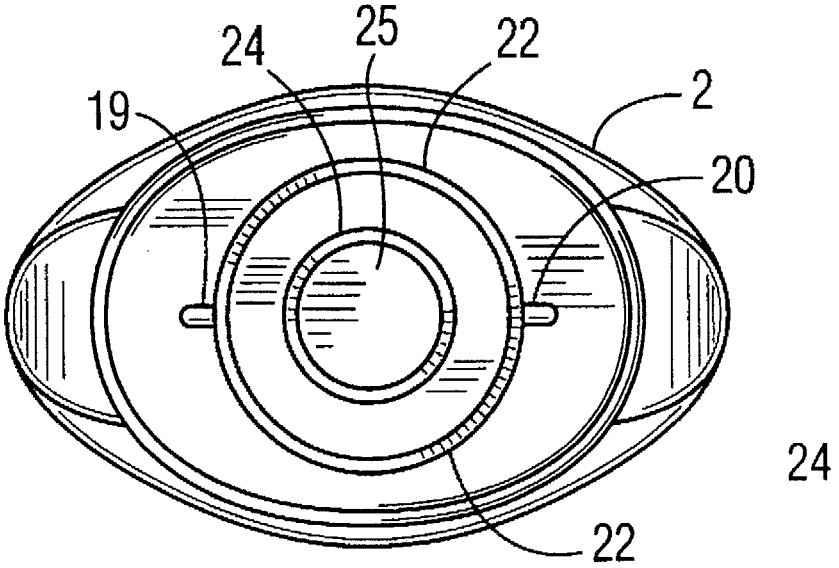
FIG. 7 shows a bottom plan view of the first container of FIG. 1.
Figure 8:
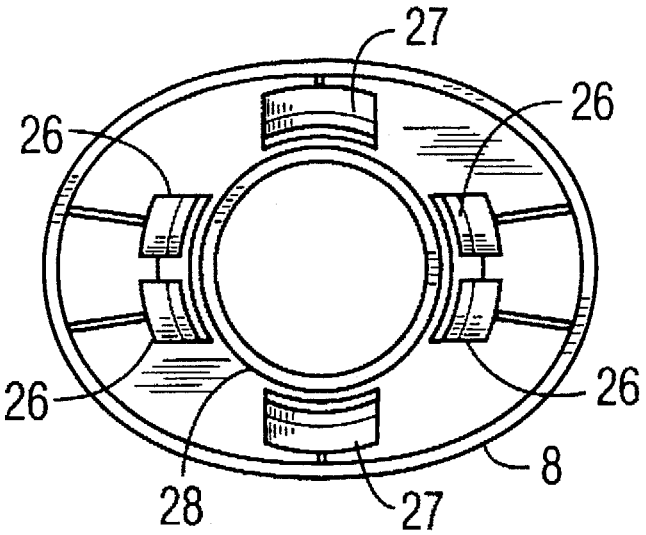
FIG. 8 shows a top plan view of the skirt of FIG. 3.

Also, with reference to FIG. 7, showing the bottom view of container 2, in this embodiment, note that the retaining flange 22 is semicircular, or provided in two halves between bosses 19 and 20, as shown. The inlet port 24 is concentric with retaining flange 22 and includes an opening 25. With reference to FIG. 8, the outer circumference of skirt 8 is oval or elliptical in shape as is the top of container 2 shown in FIG. 7, in this example, with the two shapes being substantially dimensionally identical. With further reference to FIG. 8, note that two pairs of opposing retaining fingers 26 are located immediately on either side of the major diameter of skirt 8, and that two additional retaining fingers 27 are opposingly located and symmetrical with the minor diameter of skirt 8 on either side of the boss 28, as shown. When the skirt 8 is pushed up toward the bottom of the container 2, and properly oriented, the retaining fingers 26 and 27 will snap onto the retaining ring or flange 22, as previously described.

With reference to FIG. 3, the neck of the container 10 includes a first portion 30 having male threads 32 formed thereon. Neck first portion 30 terminates at its top edge to a reduced diameter central portion 34, which in turn terminates at its top portion to a step down neck portion 36 that is less in diameter than the diameter of the reduced portion 34, as shown. The male threads 32 of neck portion 30 are configured for mating with, and permitting the container 10, to be screwed into the female threads 38 of boss 28 (see FIGS. 4 and 6).

Figure 4:
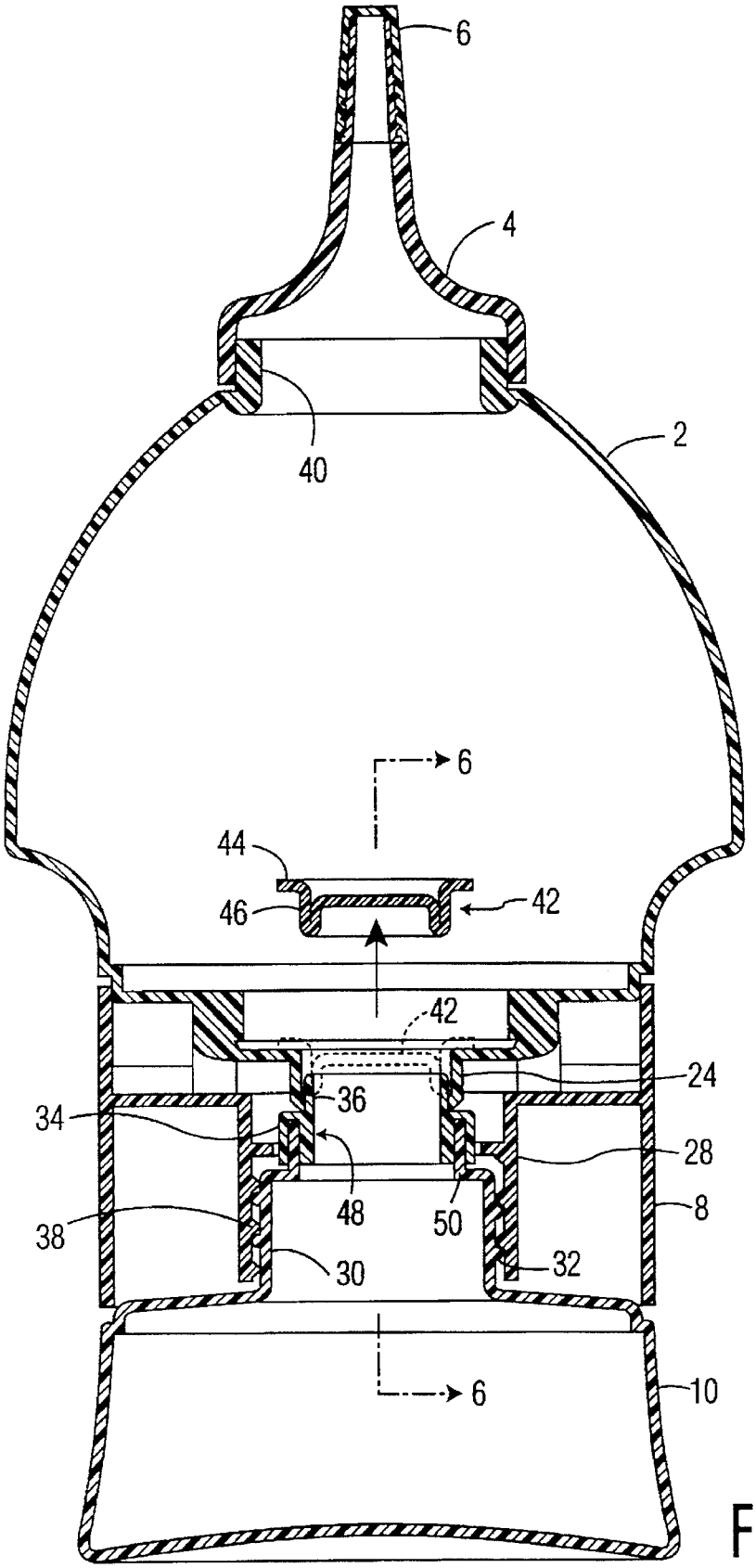
FIG. 4 shows a longitudinal cross sectional view taken along 4—4 of the container configuration of FIG. 1, for showing details of the first and second containers when mated.

With further reference to FIG. 4, note that the dispensing nozzle 4 is rigidly attached to the neck 40 of container 2 at the top opening thereof, as shown. Also, a plug cap 42 includes a top flange 44 of relatively large diameter, and a centrally located hub portion 46 of lesser diameter dimensioned for frictionally fitting within and sealing off the opening of the port 24 as shown in phantom. Also, with further reference to FIG. 4 note that the container 10 is shown with its threaded neck portion 30 screwed into the female threaded boss portion 28 of skirt 8. A transverse web portion 29 projects inward from an upper interior wall portion of the skirt 8 to hub or boss portion 28 for retaining the latter. The topmost reduced portion 36 of the neck of container 10 frictionally engages the inside walls of the port 24, for in a preferred embodiment creating a leak proof seal therewith for preventing liquid from leaking around these coupled members.

Figure 5:
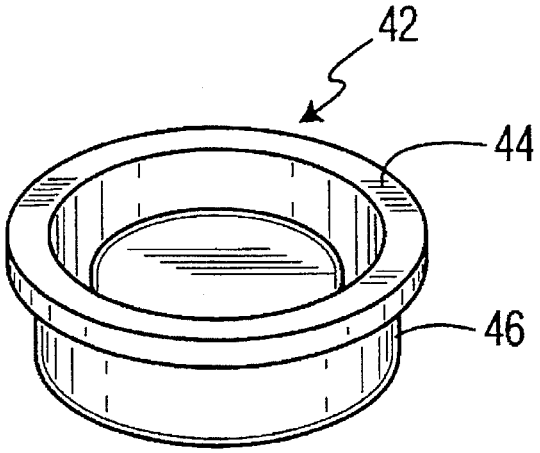
FIG. 5 shows a pictorial view of a plug for sealing an inlet port of the first container for one embodiment of the invention.

FIG. 6, a partial cross sectional view taken along 6—6 of FIG. 4 is shown. Note further that in FIG. 6 the plug 42 is shown in place for sealing off the port 24, as previously described. Also, with reference to FIG. 5, a pictorial view of the plug 42 is shown.

With further reference to FIG. 4, note that the uppermost stepped reduced portions 34 and 36 of the neck of container 10 is shown to be formed from an individual piece part 48 that is secured to an upright projecting flange 50 from neck portion 30 of container 10. This configuration was used in an engineering prototype for the container 10, and in practice the container 10 may be formed from a single piece of plastic, for example.

In this example, the container 2, container 10, dispensing nozzle 4, cap 6, plug 42, and cap 12 are all formed from single pieces of plastic material. All of these various components are semi flexible, and of relatively thin wall construction.

A description of the manner in which the present inventive container system is used will now be given. For the example of a two component hair dye product, with reference to FIG. 2, each of the containers 2 and 10 are filled with a predetermined amount of an individual component of the hair dye. The container 2 is shipped and sold with the apron or skirt 8 installed as shown, and with the cap 6 secured thereto. Similarly, the container 8 is shipped and sold with the cap 12 in place. As indicated, each contains a different component of the two component hair dye of this example. Also, container 2 is first configured to have the plug 42 sealing off the port 24 before any hair dye component is injected into container 2.

To prepare the hair dye for use, a user will first remove the cap 12 from the container 10, and thereafter screw the neck of container 10 into the threaded boss 28 of skirt 8, for causing the uppermost reduced portion 36 of the neck of bottle 10 to force plug 42 out of port 24 of container 2 to cause the outside walls of the neck portion 36 to frictionally engage inner wall portions of port 24. In use, to insure that no leakage of fluid occurs, it is preferred that the container 2 be large enough to be only partially filled with an associated individual one component of the hair dye, to permit the container 2 to be inverted with the dispensing nozzle 4 pointed downward, after container 10 is screwed into the bottom port of 24 of container 2. In this manner, as soon as the plug 42 is dislodged, the other components of the hair dye in container 10 will drop into the container 2 via port 24. While continuing to hold the container 2 inverted, the joined bottles are shaken in order to mix the hair dye components together, whereafter the cap 6 is removed from the dispensing nozzle 4 of container 2 for permitting the hair dye to be dispensed onto the hair of the user. Note that in order to insure that liquid does not leak out of the dual container system as the containers 2 and 10 are being joined together via a skirt 8, as previously described, it is necessary to allow for the reduced neck portion 36 of container 10 to sealingly engage sidewalls of the port 24 before actually forcing the plug 42 out of sealing connection with the port 24.

Although various embodiments of the present invention have been shown and described herein, they are not meant to be limiting. Those of skill in the art may recognize certain modifications to these embodiments, which modifications are meant to be covered by the spirit and scope of the appended claims.

What is claimed is:

1. A dual container and dispensing package system for a liquid product including first and second components which must be mixed together prior to use, said system comprising:

a first container for holding a predetermined amount of said first component;

said first container including:

a top opening;

a dispensing nozzle affixed to said top opening;

a bottom including a hole;

a port means formed about said hole in said bottom for permitting access to the interior of said first container;

a removable plug means for sealing off the hole in said port means from the interior of said first container;

a second container for holding a predetermined amount of said second component, said second container including:

a closed bottom;

a neck formed about a hole in a top surface, an uppermost portion of said neck being configured for a tight frictional fit within the hole of said port means of said first container, thereby permitting this upper neck portion to be forced into said hole of said port means of said first container for dislodging said removable plug therefrom to provide for mixing together of said first and second components, and dispensing of the resultant liquid product from the dispensing nozzle of said first container;

a skirt including:

outer walls configured to the shape of the circumference of the bottom of said first container;

first retention means located in an upper interior portion of said skirt, for attaching said skirt to the bottom of said first container;

an interior hub located below said first retention means, concentric with said outer walls, and interior walls of said interior hub having female threads;

said first container further including second retention means located adjacent said port means of said first container, for receiving said first retention means of said skirt, to secure said skirt and first container together;

said second container further including male threads about a lowermost portion of its said neck, thereby permitting it to be screwed into said hub of said skirt, while forcing the uppermost portion of the neck to force its way into the hole of said port means of said first container to dislodge said plug means therefrom and permit mixing together of said first and second components, said second container being retained in position at said port means via said skirt;

said skirt further including:

a transverse web portion at said upper interior portion of said skirt projecting inward from interior wall portions thereof to said interior hub, thereby retaining said interior hub;

said first retention means consisting of a plurality of opposing and spaced apart upwardly projecting semiflexible locking fingers proximate a circular opening of the top of said hub, said fingers projecting upward from and being attached to said transverse web portion; and said second retention means of said first container including a mounting ring formed between a pair of opposing standoffs proximate said port means, said mounting ring being configured for permitting said locking fingers of said first retention means to snap onto it for retaining said skirt on the bottom of said first container.

2. The system of claim 1, further including:

a tip of said dispensing nozzle being configured for receiving a sealing cap; and a first sealing cap for sealing of the tip of said dispensing nozzle.

3. The system of claim 1, further including:

a cap for sealing off the opening of the neck of said second container.

* * * * *